United States Patent [19]

Yamazaki

[11] Patent Number: 4,889,783

[45] Date of Patent: Dec. 26, 1989

[54] PRINTING MEMBER FOR ELECTROSTATIC PHOTOCOPYING

[75] Inventor: Shunpei Yamazaki, Tokyo, Japan

[73] Assignee: Semiconductor Energy Laboratory Co., Ltd., Kanagawa, Japan

[21] Appl. No.: 116,337

[22] Filed: Nov. 2, 1987

Related U.S. Application Data

[60] Division of Ser. No. 814,083, Dec. 24, 1985, abandoned, which is a continuation of Ser. No. 502,583, Jul. 21, 1983, abandoned, which is a division of Ser. No. 276,503, Jun. 23, 1981, Pat. No. 4,418,132.

[30] Foreign Application Priority Data

Jun. 25, 1980 [JP] Japan ..... 55-86801

[51] Int. Cl.[4] ..... G03G 5/082; G03G 5/14

[52] U.S. Cl. ..... 430/57; 430/66; 430/67

[58] Field of Search ..... 430/57, 60, 66, 67, 430/84, 95; 252/501.1; 357/2; 427/74

[56] References Cited

U.S. PATENT DOCUMENTS

| | | | |
|---|---|---|---|
| 3,443,938 | 5/1969 | Bean et al. | 430/66 X |
| 3,649,116 | 3/1972 | Hall | 430/66 X |
| 3,650,737 | 3/1972 | Maissel et al. | 430/67 X |
| 4,226,898 | 10/1980 | Ovshinsky et al. | 430/84 X |
| 4,239,554 | 12/1980 | Yamazaki | 136/255 |
| 4,388,482 | 6/1983 | Hamakawa et al. | 357/2 X |

FOREIGN PATENT DOCUMENTS

| | | | |
|---|---|---|---|
| 55-29154 | 3/1980 | Japan | 430/57 |
| 56-64347 | 6/1981 | Japan | 430/57 |

*Primary Examiner*—Roland E. Martin

*Attorney, Agent, or Firm*—Gerald J. Ferguson, Jr.

[57] ABSTRACT

A printing member for electrostatic photocopying, comprises a substrate having a conductive surface and a photoelectric-sensitive, electrically chargeable layer deposited on the conductive surface of the substrate. The electrically charageable layer has a non-single crystal semiconductor layer having a built-in-potential, or the non-single crystal semiconductor layer and an insulating or semi-insulating layer.

5 Claims, 5 Drawing Sheets

PRINTING MEMBER FOR ELECTROSTATIC PHOTOCOPYING

This is a division of Ser. No. 814,083, filed 12/24/85, now abandoned, which is a continuation of Ser. No. 502,583, filed 7/21/83, now abandoned, which is a division of 276,503, filed 6/23/81, now U.S. Pat. No. 4,418,132.

BACKGROUND OF THE INVENTION

1. Field of the Invention

The present invention relates to a printing member for electrostatic photocopying, such as a printing drum or plate.

2. Description of the Prior Art

The printing members for electrostatic photocopying are used to form on copying paper a visible image pattern corresponding to a photo or light image of the pattern to be copied in the manner described below.

The photocopying process starts with electrically charging a surface of the printing member uniformly over the entire area thereof, onto which a photo or light image of the pattern to be copied is projected to form an electrostatic latent image. Then a toner powder is applied to the surface of the printing member to develop thereon the latent image and copying paper is pressed against the surface of the printing member to print a visible image pattern on the copying paper.

There has heretofore been proposed a printing member for electrostatic photocopying which comprises a substrate having a conductive surface and a photoelectric-sensitive, electrically chargeable layer formed on the conductive surface of the substrate. The photoelectric-sensitive, electrically chargeable layer is a single layer of chalcogen such as selenium, or chalcogenide such as a selenium-cadmium or selenium-arsenic alloy.

With the conventional printing member of such an arrangement, the surface of the photoelectric-sensitive, electrically chargeable layer serves as the printing surface. Since this layer has a single-layer structure made of the abovesaid material, the surface resistance of the printing member is relatively small. Consequently, the printing surface is not sufficiently charged and a non-negligible amount of charges leaks from the printing surface.

Accordingly, the prior art printing member is defective in that the visible image pattern printed on the copying paper is poor in contrast and in SN ratio.

Further, in the conventional printing member the electrically chargeable layer serves as the printing surface and has the single-layer structure as described above and, consequently, there is not produced in the electrically chargeable layer such a built-in-potential by which electrical carriers created by incident light are directed to the conductive surface of the substrate. Therefore, the electrostatic charge image cannot effectively be formed on the printing surface. The reason is as follows: The electrostatic charge image is obtained by the mechanism that charges on the printing surface at those areas irradiated by light are neutralized by electrical carriers(for example, electrons)created by light irradiation in the electrically chargeable layer, whereas other electrical carriers (holes) are discharged to the conductive surface of the substrate. Accordingly, for the formation of the electrostatic charge image it is desirable that the electrical carriers (holes) developed by the light irradiation in the electrically chargeable layer be rapidly released to the conductive surface of the substrate. Since the electrically chargeable layer of the conventional printing member is not of the structure that develops therein the aforementioned built-in-potential, however, the electrical carriers (holes) are not quickly discharged to the conductive surface of the substrate.

In consequence, the printing member employed in the past has the drawbacks that the visible image printed on the copying paper is poor in contrast and small in SN ratio.

Moreover, the prior art printing member is relatively small in the wear-resistance of the printing surface because the electrically chargeable layer acts as the printing surface. Hence it has a relatively short lifetime.

Besides, the aforesaid material used for the electrically chargeable layer is poisonous and cancer-developing; therefore, the fabrication of the conventional printing member involves danger and care should be taken of in the handling of the printing member itself and the copying paper with the visible image printed thereon.

SUMMARY OF THE INVENTION

Accordingly, it is an object of the present invention to provide a novel printing member for electrostatic photocopying which is free from the aforesaid defects of the prior art.

In accordance with an aspect of the present invention, the printing member comprises a substrate having a conductive surface and a photoelectric-sensitive, electrically chargeable layer deposited on the conductive surface of the substrate. The electrically chargeable layer has a non-single crystal semiconductor layer and an insulating or semi-insulating layer formed thereon and permeable to light and electrical carriers. In this case, the surface of the insulating or semi-insulating layer can be used as the printing surface. The surface resistance of the insulating or semi-insulating layer can be increased far greater than the surface resistance of the conventional printing member. This permits effective charging of the printing surface and avoids unnecessary leakage of charges from the printing surface.

Further, the non-single crystal semiconductor layer can be formed by a first P or N type layer situated on the side of the substrate and a second I type layer deposited on the first layer to create a P-I or N-I transition region. In consequence, there is provided in the electrically chargeable layer a built-in-potential by which electrical carriers resulting from the incidence of light are directed to the conductive surface of the substrate. This ensures to form an electrostatic charge image on the printing surface more effectively than in the case of the prior art printing member.

Consequently, the printing member of the present invention has the advantage that a visible image pattern can be printed on copying paper with a good contrast and a high SN ratio, as compared with the printing member employed in the past.

Moreover, the insulating or semi-insulating layer may also be used as the printing surface and the wear-resistance of this layer can be increased larger than in the case of the conventional printing member.

Therefore, the printing member of the present invention withstands a far longer use than does the conventional printing plate; namely, it is highly excellent in durability.

In addition, the electrically chargeable layer can be formed of an innocuous and non-cancer-developing material.

Accordingly, the printing member of the present invention does not involve danger in its fabrication unlike the conventional printing member and not so much care need be taken of in the handling of the printing member itself and the copying paper having printed thereon the visible image pattern.

Furthermore, the electrically chargeable layer may further include a charge storing non-single crystal semiconductor layer and a charge storing insulating or semi-insulating layer both of which are sandwiched between the non-single crystal semiconductor layer and the insulating or semi-insulating layer, but the former of which lies on the side of the insulating or semi-insulating layer and the latter of which lies on the side of the non-single crystal semiconductor layer.

This structure brings about the advantage that even after the electrostatic charge image on the printing surface is removed by one printing, a charge image corresponding to the electrostatic charge image is stored in the charge storing non-single crystal semiconductor layer to permit subsequent copying of the charge image; hence, a number of copies of the same visible image can be made.

In accordance with another aspect of the present invention, the printing member comprises a substrate having a conductive surface and a photoelectric-sensitive, electrically chargeable layer formed on a conductive surface of the substrate. The electrically chargeable layer is formed of a non-single crystal semiconductor, which has a first P or N type layer lying on the side of the substrate, a second I type layer formed on the first P or N type layer to create a first P-I or N-I transition region, and a third N or P type layer formed on the second I type layer to create an N-I or P-I transition region. In this case, the third layer can be employed as the printing surface and its surface resistance can be increased as mentioned previously.

By the provision of the aforesaid first, second and third layers, the electrically chargeable layer is formed to have a built-in-potential by which electrical carriers developed by incidence of light are directed to the conductive surface of the substrate.

Accordingly, the printing member of the abovesaid arrangement is also capable of printing a visible image pattern on copying paper with good contrast and high SN ratio.

The third layer can be used as the printing surface, as referred to above, and in this case, its wear-resistance can be increased to ensure a long life span of the printing member.

Also in the printing member of the above arrangement, the electrically chargeable layer can be formed of an innocuous and non-cancer-developing material.

Similarly, the electrically chargeable layer may further include an insulating or semi-insulating layer which is situated on the non-single crystal semiconductor layer and permeable to light and electrical carriers.

Accordingly, it is possible to produce the same effect as mentioned previously in connection with the insulating or semi-insulating layer.

Furthermore the electrically chargeable layer can be constituted by forming a charge storing non-single crystal semiconductor layer and a charge storing insulating or semi-insulating layer between the abovesaid insulating or semi-insulating layer and the non-single crystal semiconductor layer.

Other objects, features and advantages of the present invention will become more apparent from the following description taken in conjunction with the accompanying drawings.

DESCRIPTION OF THE PREFERRED EMBODIMENTS

Figure 1:
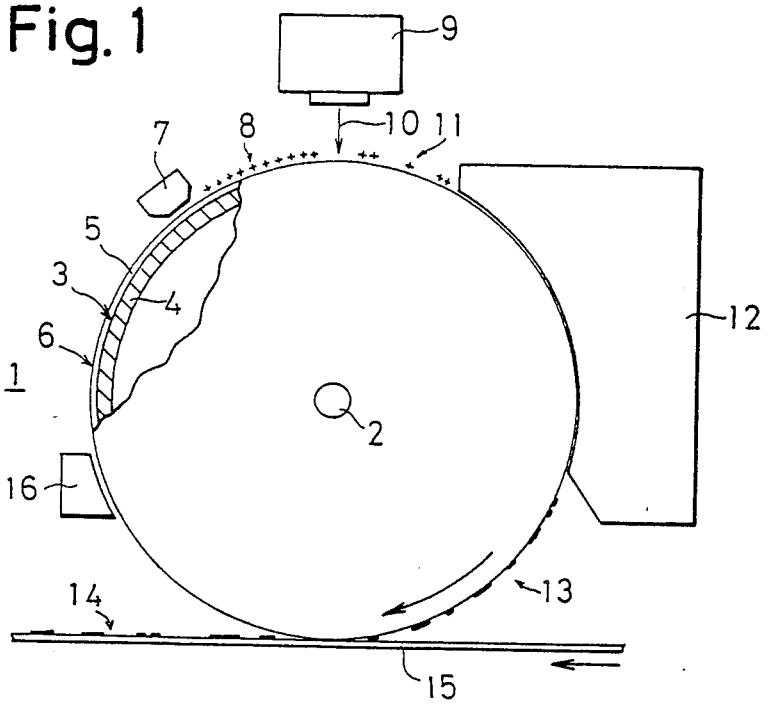
FIG. 1 is a schematic diagram explanatory of the principles of an electrostatic photocopying method using the printing member of the present invention.

FIG. 1 is a diagrammatic showing of the principles of the electrostatic photocopying method employing a printing member 1 of the present invention.

The printing member 1 is shown to be a drum 20 to 40 cm in diameter and 50 to 100 cm long, for example, and it is driven by a motor (not shown) coupled with a shaft 2. The printing drum 1 comprises a substrate 4 having a conductive surface 3 and a photoelectric-sensitive, electrically chargeable layer 5 deposited on the conductive surface 3. The construction of such a printing drum 1 is similar in appearance to conventional printing drums.

The electrostatic photocopying method using the printing drum 1 is common in principles to the prior art printing drums. Accordingly, a brief description will be given of the method.

The surface of the layer 5 and consequently a surface 6 of the printing drum is electrically charged, for example, positive uniformly by electrical charging means 7, positive charges being indicated by 8. Then a photo or light image 10 of a pattern is projected onto the drum surface 6 by photo or light image projecting means 9 disposed adjacent the drum 1, forming an electrostatic charge image 11 on the drum surface 6. The electrostatic charge image 11 is obtained by such a mechanism as follows: When the light image 10 is projected onto the drum surface 6, there are created in the layer 5 at those areas irradiated by light electron-hole pairs in an amount corresponding to the intensity of incident light, the positive charges 8 on the drum surface 6 are neutralized by the electrons and the holes are directed to the conductive surface 3 of the substrate 4.

After this, a toner (not shown) is applied to the drum surface 6 by developing means 12 disposed adjacent the drum 1, thereby developing the electrostatic charge image 11 to form a visible image pattern 13 on the drum surface 6. The visible image pattern 13 is obtained by such a mechanism that the toner sticks to the drum surface 6 at those areas where the charges forming the electrostatic charge image 11 lie, the amount of toner sticking to the drum being dependent on the charge intensity.

Next, copying paper 15 is fed to be pressed against the drum surface 6, printing the visible image pattern 13 on the copying paper 15 as indicated by 14.

Thereafter, the drum surface 6 is cleaned by cleaning means 16 disposed in contact with or in adjacent but spaced relation to the drum 1.

The drum surface 6 thus cleaned is electrically charged again by the electrical charging means 7 and thereafter it is subjected to the same processes as described above.

Figure 2A:
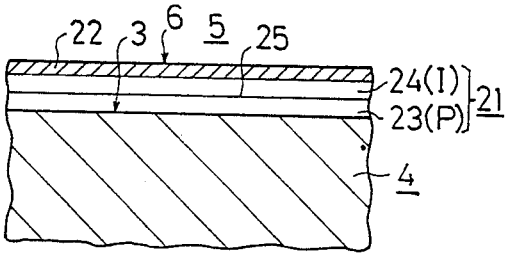
FIGS. 2A and 2B show a mechanical structure and an energy band structure of a first embodiment of the printing member of the present invention.
Figure 2B:
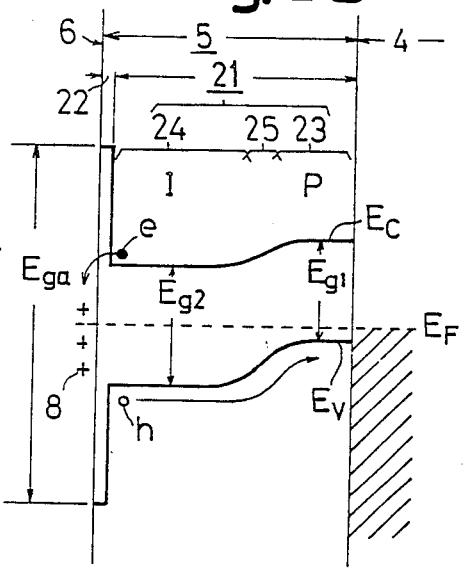

The printing member 1 is shown more in detail in FIGS. 2A and 2B.

As described above, the printing member 1 is provided with the substrate 4 having the conductive surface 3 and the photo-electric-sensitive, electrically chargeable layer 5.

The substrate 4 is formed of aluminum or like metal material.

The layer 5 is composed of a non-single crystal semiconductor layer 21 formed on the side of the substrate 4 and an insulating layer 22 deposited on the layer 21.

The layer 21 is formed principally of Si, $Si_3N_{4-x}$ ($0<x<4$), $SiC_{1-x}$($0<x<1$), $SiO_{2-x}$($0<x<2$) or like composition. The layer 21 is composed of a first layer 23 deposited on the base member 4 and a second layer 24 formed on the first layer 23 so as to create a transition region 25. The first layer 23 is doped with a P type impurity such as boron, indium or the like. The second layer 24 is not doped with either of P and N type impurities or doped with both of them to compensante for each other. The transition region 25 is a PI transition region.

The insulating layer 22 is a non-single crystal semiconductor layer which is formed principally of $Si_3N_{4-x}$($0<x<4$), $SiC_{1-x}$($0<x<1$) or the like, as is the case with the layer 21, but the layer 22 has a higher degree of insulation than does the layer 21. Accordingly, in the case where the layers 21 and 22 are both formed of $Si_3N_{4-x}$ or $SiC_{1-x}$, the value of x in the layer 22 is larger than in the layer 21.

The insulating layer 22 is formed thin enough to permit the passage therethrough of incident light to the side of the layer 21 and electrical carriers (electrons e in this case) from the side of the layer 21 to the surface of the layer 22, i.e. the surface 6 of the printing member 1.

Energy band gaps $Eg_1$, $Eg_2$ and $Eg_a$ of the first and second layers 23 and 24 and the insulating layer 22 bear such relationships $Eg_1<Eg_2<<Eg_a$ as depicted in FIG. 2B. In FIGS. 2B, 4B, 5B, 6B, 7B, 7C, 8B and 9B, reference character $E_F$ represents the Fermi level, $E_C$ the bottom of a conductance band and $E_V$ the bottom of a valence band. In the case where the first layer 23, the second layer 24 and the insulating layer 22 are all formed of $Si_3N_{4-x}$ or $SiC_{1-x}$, the value of x is the largest in the insulating layer 22, the smallest in the first layer 23 and intermediate between them in the second layer 24. In a preferred embodiment the first layer 23 is formed principally of non-single crystal silicon with $Eg_1=1.0$ to 1.8 eV, the second layer 24 is formed principally of non-single crystal $Si_3N_{4-x}$ (containing 10 to 50 mol % of nitrogen) with $Eg_2=2.0$ to 3.0 eV and the insulating layer 22 is formed of non-single crystal $Si_3N_4$ with $Eg_a\approx5.0$ eV, the layer 22 being 30 to 100 Å thick.

A description will be given, with reference to FIGS. 3A and 3B, of the fabrication of the printing member 1 of the present invention.

Figure 3A:
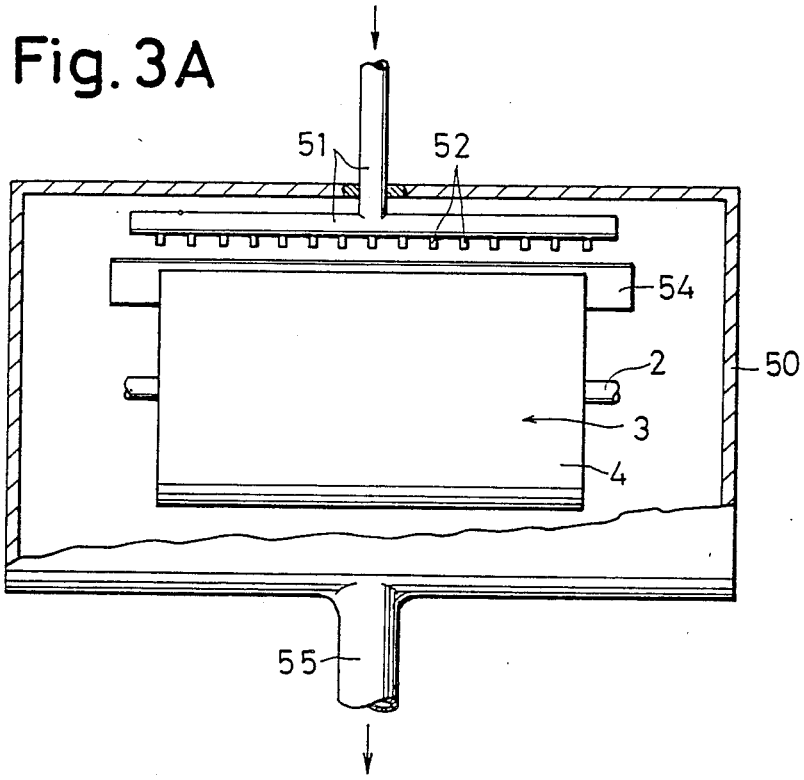
FIGS. 3A and 3B are explanatory of the principles of a manufacturing method of the printing member of the present invention.

FIG. 3A shows the state in which a drum of the substrate 4 having the conductive surface 3 and the shaft 2 is situated in a vacuum furnace 50 so as to form the photoelectric-sensitive, electrically chargeable layer 5 on the conductive surface 3. FIG. 3B shows the state in which the abovesaid layer 5 has just been formed on the conductive surface 3 of the substrate 4.

In the vacuum furnace 50 a number of nozzles 52, which communicate with a gas inlet pipe 51, are disposed opposite the conductive surface 3 of the substrate 4. Further, electrodes 53 and 54 are placed in the furnace 50 in opposing relation to the conductive surface 3 of the substrate 4. An outlet pipe 55 is led out from the vacuum furnace 50 on the opposite side from the nozzles 52 with respect to the drum 4.

The drum 4 is continuously driven at a speed of 0.1 to 1 r.p.s. by a motor (not shown) coupled with the shaft 2. The interior of the vacuum furnace 50 is exhausted at all times by an exhausting pump (not shown) connected to the outlet pipe 55. In such a state a cleaning gas such as for example, Ar gas or a mixture gas of Ar and $H_2$ or the like is supplied into the vacuum furnace 50 through the inlet pipe 51 and the nozzles 52. At the same time, a predetermined voltage is applied across the electrodes 53 and 54 via leads 55 and 56, thereby rendering the cleaning gas into a plasma to clean the conductive surface 3 of the substrate 4.

The substrate 4 is heated by heating means (not shown) at a temperature between 200° and 400° C. and a semiconductor material gas or gases and a P type impurity material gas are introduced, along with a carrier gas such as helium gas, into the vacuum chamber 50 through the inlet pipe 51 and the nozzles 52 to fill the space between the conductive surface 3 of the substrate 4 and the nozzles 52. At this time, a predetermined DC voltage, which is superimposed on a high-frequency voltage of a frequency between 0.01 and 50 MHz or between 1 and 10 GHz and of a power in the range of 100W to 1KW, is provided across the electrodes 53 and 54 via the leads 55 and 56, to render the semiconductor material gas or gases, the P type impurity material gas and the carrier gas into plasma. As a result of this, the semiconductor material or materials doped with the P type impurity material are deposited on the conductive surface 3 to form the first P type layer 23. In the case where the first P type layer 23 is formed as a non-single crystal silicon layer, a semiconductor material gas can be selected from the groups consisting of $SiH_4$, $SiH_2Cl_2$, $SiCl_4$ and $SiF_4$ gases and $B_2H_6$ or $InCl_3$ gas can be used as the P type impurity gas. The semiconductor material gas or gases, the P type impurity gas and the helium gas as the carrier gas can be mixed in a volume percent ratio of 3~28%:95~67%:0.1~5%.

When the first layer 23 has been formed to a predetermined thickness, the semiconductor material gas or gases introduced into the vacuum chamber 50 until then are switched to another or other gases and the introduction of the P type impurity material gas into the chamber 50 is suspended or an N type impurity material gas is introduced along with the P type one. And the semiconductor material gas or gases and the carrier gas are rendered into plasma. It is a matter of course that when the P type and N type impurity gases are both introduced into the chamber 50, they are similarly rendered into a plasma. In consequence, the I type second layer 24 is formed on the first layer 23 through the PI transition region 25. When the I type second layer 24 is deposited as a non-single crystal $Si_3N_{4-x}$ layer, a gas selected from the group consisting of $SiH_4$, $SiH_2Cl_2$, $SiCl_4$ and $SiF_4$ gases and ammonia or nitrogen gas are used as the semiconductor material gases. In this case, the semiconductor material gases can be mixed in the ratio of 99~70 mol %: 1~30 mol % in terms of silicon and nitrogen. By substituting methane gas for the ammonia or nitrogen gas included in the semiconductor material gases, the second layer 24 can be formed as an $SiC_{1-x}$ layer.

Then, when the second layer 24 has been formed to a predetermined thickness, the introduction of the semiconductor material gas or gases into the vacuum chamber 50 is stopped and, instead, methane, ammonia or nitrogen gas is supplied into the vacuum chamber 50 and rendered into plasma together with a carrier gas. As a result of this, the surface of the second layer 24 is carbonized or nitrified to provide the insulating layer 22 formed by carbide or nitride of the non-single crystal semiconductor forming the second layer 24. Where the second layer 24 is formed of $SiC_{1-x}$, the insulating layer 22 formed of SiC can be obtained by supplying methane gas into the vacuum chamber 50. Where the second layer 24 is formed of $Si_cN_{4-x}$, an insulating layer of $Si_3N_4$ can be obtained by introducing ammonia or nitrogen gas.

In this way, the printing member 1 of the present invention described previously in respect of FIGS. 2A and 2B is obtained.

The above is the arrangement of the first embodiment of the printing member 1 of the present invention. In this embodiment the insulating layer 22 constitutes the printing surface 6 of the drum 1; this permits effective generation of the charges 8 on the printing surface 6 and prevents unnecessary leakage therefrom of the charges 8. Since the non-single crystal semiconductor layer 21 has the first P type layer 23 and the second I type layer 24 formed thereon through the PI transition region 25, the layer 21 has formed therein the built-in-potential, by which holes of electron-hole pairs developed by light irradiation in the layer 21 are quickly directed to the conductive surface 3 of the substrate 4. As the insulating layer 22 can be formed of $Si_3N_{4-x}$ or $SiC_{1-x}$, in particular, $Si_3N_4$ *l or SiC, the printing surface* 6 *has a great resistance to abrasion. The non-single crystal semiconductor* 21 *can be formed of Si,* $Si_3N_{4-x}$, $SiC_{1-x}$ or the like and the insulating layer 22 can be formed of $Si_3N_{4-x}$, $SiC_{1-x}$ or the like; therefore, the electrically chargeable layer 5 has no piosonous and cancer-developing properties.

Accordingly, the printing member 1 of the first embodiment illustrated in FIGS. 2A and 2B exhibits the advantages referred to previously at the beginning of this specification.

According to the printing member 1 depicted in FIGS. 2A and 2B, the energy band gap $Eg_2$ of the second layer 24 forming the non-single crystal semiconductor layer 21 is larger than the energy band gap $Eg_1$ of the first layer 23; this promotes that the electrons e produced by incident light are directed to the printing surface 6 and that the holes h are directed to the conductive surface 3 of the substrate 4. As a result, the visible image pattern can be obtained on copying paper with good contrast and high SN ratio.

Moreover, since the speed at which the carriers (the holes h in this case) yielded by incident light are directed towards the substrate 4 by the aforesaid built-in-potential in the layer 21 can be increased as high as 10 to $10^3$ times that in the case of the conventional printing member, the thickness of the electrically chargeable layer 5 can be reduced to ½ to ⅓ that required in the prior art correspondingly, for example, 100 to 300±50 μm. This leads to curtailment of the amount of material for the layer 5 and eliminates the possibility of the layer 5 cracking due to thermal stress caused by a difference in thermal expansion coefficient between the substrate 4 and the layer 5.

Figure 4A:
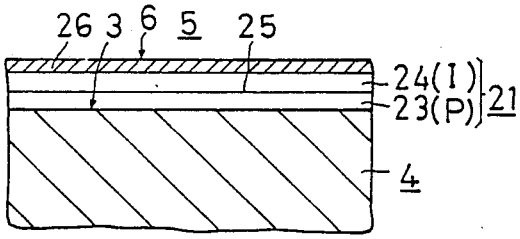
FIGS. 4A and 4B show a mechanical structure and an energy band structure of a second embodiment of the present invention.
Figure 4B:
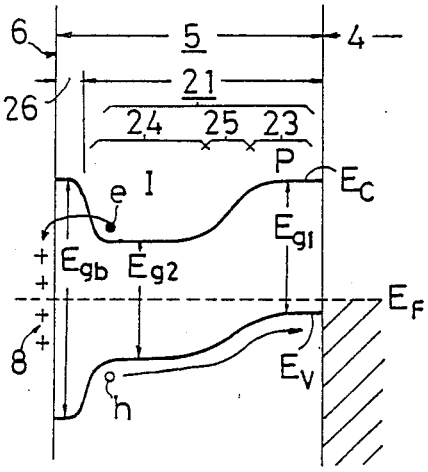

FIGS. 4A and 4B illustrate a second embodiment of the printing member of the present invention. The parts corresponding to those in FIGS. 2A and 2B are identified by the same reference numerals and no detailed description will be repeated. This embodiment is identical in construction with the embodiment of FIG. 2 except that the insulating layer 22 is replaced with a semi-insulating layer 26. In this embodiment, however, the energy band gaps $Eg_1$, $Eg_2$ and $Eg_b$ of the first layer 23, the second layer 24 and the semi-insulating layer 26 bear such relationship as $Eg_1 \approx Eg_2 << Eg_b$. As a result of this, in a preferred embodiment the first and second layers 23 and 24 are formed primarily of non-single crystal silicon with $Eg_1 = Eg_2 = 1.0$ to 1.8 eV and the semi-insulating layer 26 is formed of non-single crystal $Si_3N_{4-x}$ to a thickness of 50 to 500 Å.

Figure 3B:
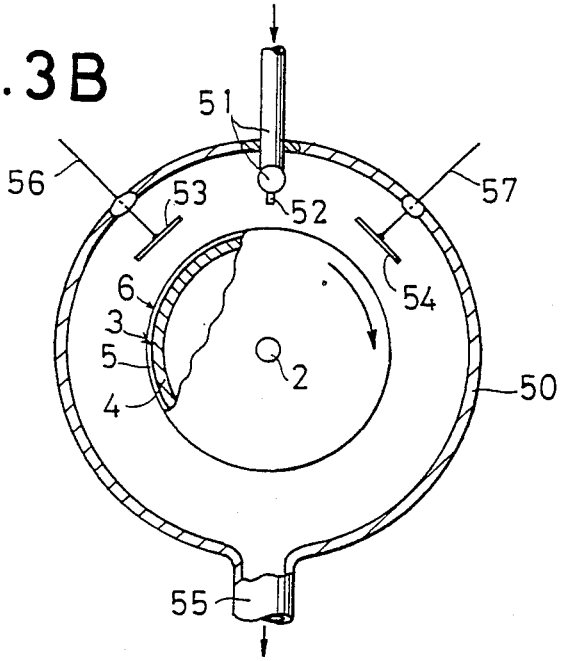

The printing member 1 shown in FIGS. 3A and 3B can equally be produced by the same method described previously with regard to FIGS. 2A and 2B; therefore, no detailed description will be repeated. The semi-insulating layer 20 can be formed, after the formation of the second layer 24, by introducing into the vacuum furnace semiconductor material gas or gases different from those supplied until then.

It will be appreciated that, though not described in detail, the printing member 1 shown in FIG. 3 also possesses the same advantages obtainable with the printing member 1 of FIG. 2.

Figure 5A:
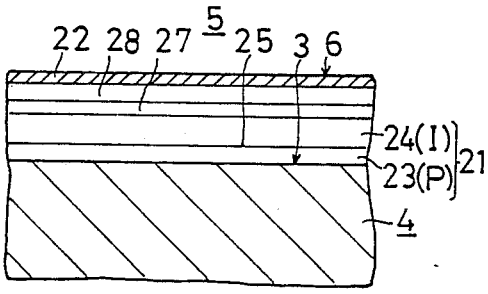
FIGS. 5A and 5B show a mechanical structure and an energy band structure of a third embodiment of the present invention.
Figure 5B:
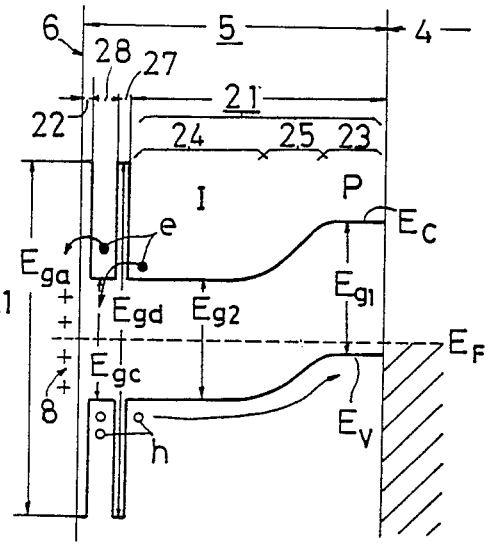

FIGS. 5A and 5B illustrate a third embodiment of the printing member 1 of the present invention. The parts corresponding to those in FIGS. 2A and 2B are marked with the same reference numerals and no detailed description will be repeated. This embodiment is also identical in construction with the embodiment of FIGS. 2A and 2B except that there are provided between the non-single crystal semiconductor 21 and the insulating layer 22 a charge storing non-single crystal semiconductor layer 28 on the side of the layer 22 and a charge storing insulating layer 27 on the side of the layer 21. In this embodiment, however, the energy band gaps $Eg_1$, $Eg_2$ and $Eg_a$ of the first layer 23, the second layer 24 and the insulating layer 22 bear such relationships as $Eg_1 \approx Eg_2 << Eg_a$. The layer 28 is formed primarily of Si, $Si_3N_{4-x}$ $(0<x<4)$, $SiC_{1-x}(0<x<1)$, $SiO_{2-x}(0<x<2)$ or the like as is the case with the layer 21, and it is an assembly of semiconductor grains or clusters having a diameter of 50 Å to 2μ, for example, and electrically isolated from one another. The layer 28 has a thickness small enough to pass therethrough incident light from the side of the insulating layer 22 to the side of the insulating layer 27, for example, 50 Å to 5 μ. The insulating layer 27 is a non-single crystal semiconductor layer formed primarily of $Si_3N_{4-x}$, $SiC_{1-x}$ or the like, as is the case with the insulating layer 21, and it has also insulating properties. The thickness of the layer 27 is small enough to pass therethrough incident light from the side of the layer 28 to the side of the layer 21 and to pass therethrough the electrical carriers (the electrons in this case) from the side of the layer 21 to the side of the layer 28. The energy band gap $Eg_c$ of the layer 28 can be selected to be equal to or larger than the energy band gap $Eg_2$ of the layer 24 and the energy band gap $Eg_d$ of the layer 27 can be selected to be larger than the energy band gap $Eg_c$ and equal to $Eg_a$.

The printing member 1 of the embodiment shown in FIGS. 5A and 5B can be produced by the method described previously in connection with FIGS. 2A and 2B; accordingly, no detailed description will be repeated. The charge storing layers 27 and 28 can be formed in succession after the formation of the layer 21 and before the formation of the insulating layer 22.

With the printing member 1 depicted in FIGS. 5A and 5B, the electrostatic charge image 11 is obtained on the surface of the layer 22, i.e. the printing surface 6 by such a mechanism that electrons e created by incident light in the layer 21 are injected into the layer 28 through the layer 27 and reach the printing surface 6 to neutralize the charges 8 thereon. At this time, a positive charge image corresponding to the electrostatic charge image 11 is developed in the layer 28 and stored between the insulating layers 22 and 27. Accordingly, although the electrostatic charge image 11 on the printing surface 6 disappears after the visible image pattern 14 is obtained on the copying sheet 15, the toner if applied by the developing means 12, sticks to the printing surface 6 in accordance with the intensity of the stored positive charges in the layer 28, producing a pattern similar to the visible image pattern 13. Consequently, a visible image pattern corresponding to the photo or light image 10 can be obtained on the copying paper without re-charging the printing surface 6 nor forming the electrostatic charge image 11. It is a matter of course that the printing member 1 depicted in FIGS. 5A and 5B also exhibits the advantages referred to previously with respect to FIGS. 2A and 2B.

Figure 6A:
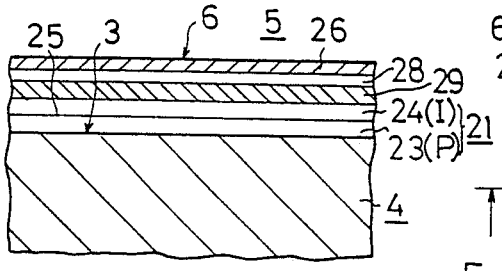
FIGS. 6A and 6B show a mechanical structure and an energy band structure of a fourth embodiment of the present invention.
Figure 6B:
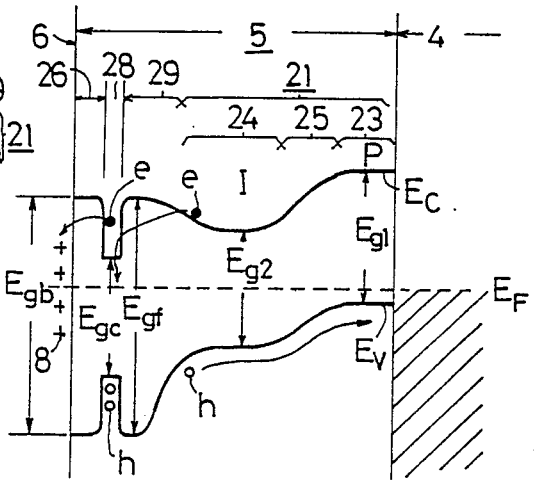

FIGS. 6A and 6B illustrate a fourth embodiment of the printing member 1 of the present invention. The parts corresponding to those in FIGS. 5A and 5B indicated by the same reference numerals and no detailed description will be given. This embodiment is identical in construction with the embodiment of FIGS. 5A and 5B except that the insulating layer 22 is substituted with a semi-insulating layer 26 similar to that employed in the embodiment of FIGS. 4A and 4B and that the insulating layer 27 is replaced with a semi-insulating layer 29 similar to the semi-insulating layer 26. In this embodiment, however, energy band gaps $Eg_1$, $Eg_2$, $Eg_b$, $Eg_c$ and $Eg_f$ of the first layer 23, the second layer 24, the insulating layer 26, the charge storing semiconductor layer 28 and the charge storing semiconductor layer 29 bear such relationships $Eg_1 \approx Eg_2 \approx Eg_c << Eg_b \approx Eg_f$. The printing member 1 of this embodiment can be produced by the method described previously in respect of FIGS. 2A and 2B; therefore, no detailed description will be given. The charge storing semiconductor layer 28 can be fomred in the same manner as described with respect to FIGS. 5A and 5B and the charge storing semi-insulating layer 29 can be formed in the same way as referred to previously in connection with FIGS. 4A and 4B.

It will be evident that the printing member 1 of this embodiment possesses the same advantages as those obtained with the embodiment described with regard to FIGS. 5A and 5B though not described in detail.

Figure 7A:
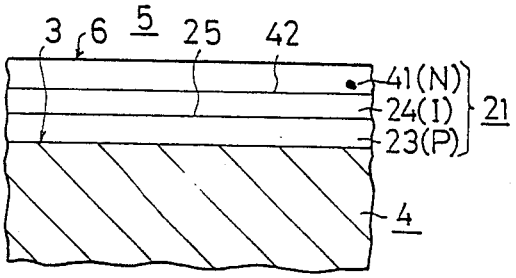
FIGS. 7A and 7B show a mechanical structure and an energy band structure of a fifth embodiment of the present invention.
Figure 7B:
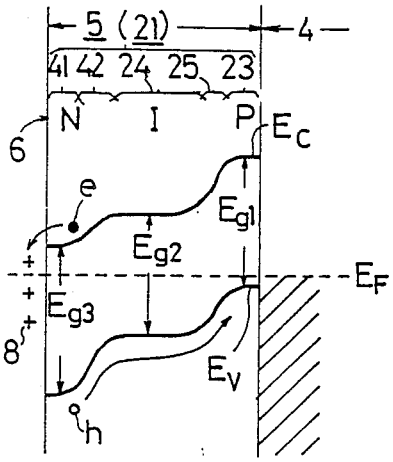

FIGS. 7A and 7B illustrate a fifth embodiment of the printing member 1 of the present invention. The parts corresponding to those in FIGS. 2A and 2B are identified by the same reference numerals and no detailed description will be given. This embodiment is identical in construction with the embodiment of FIGS. 2A and 2B except that the insulating layer 22 is left out, and that the non-single crystal semi-conductor layer 21 has a third N type layer 41 which is doped with an N type impurity material such as phosphorus P, antimony Sb or the like and formed on the second I type layer 24 so as to create an NI type transition region 42. The third N type layer 41 constitutes the printing surface 6 and it can be formed primarily of Si, $Si_3N_{4-x}(0<x<4)$, $SiC_{1-x}$ $(0<x<1)$, $SiO_{2-x}(0<x<2)$ or the like, as is the case with the layers 23 and 24, but it is preferred that the layer 41 be formed of $Si_3N_{4-x}(0<x<4)$ or $SiC_{1-x}$ $(0<x<1)$, and that the value of x is relatively large so as to provide for increased wear-resistance of the printing surface 6. The energy band gaps $Eg_1$, $Eg_2$ and $Eg_3$ of the first, second and third layers 23, 24 and 41 bear such relationships as $Eg_1 \approx Eg_2 < Eg_3$. In a preferred embodiment the first, second and third layers are all formed of $SiC_{1-x}$ and contain 10 to 50, 1 to 20 and 10 to 50 mol % of carbon, respectively. In another preferred embodiment these layers 23, 24 and 25 are all formed of $Si_3N_{4-x}$ and contain 5 to 30, 0.1 to 5 and 5 to 30 mol % of nitrogen, respectively.

The printing member 1 of this embodiment can be fabricated by the method described previously in respect of Figs. 2A and 2B; therefore, no detailed description will be made. The third layer 41 can be formed, after the formation of the second layer 24, by using a semiconductor material gas or gases different from that used until then.

According to this embodiment, since the non-single crystal semiconductor layer 21 has a PIN structure having built therein a potential and has a wide-to-narrow energy band gap structure, electrical carriers (holes h) generated by incident light are rapidly directed towards the substrate 4. Accordingly, a visible image pattern can be printed on copying paper with good contrast and large SN ratio. Further, this embodiment also exhibits the same advantages as mentioned previously in conjunction with FIGS. 2A and 2B.

Figure 7C:
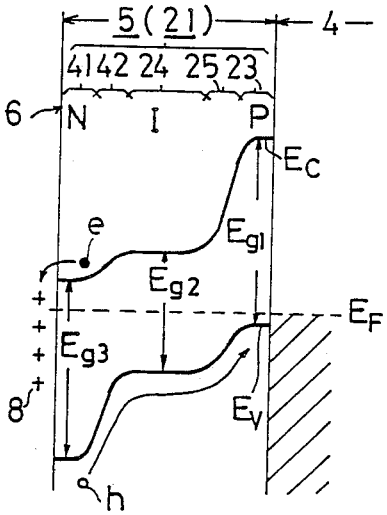
FIGS. 7C shows an energy band structure of a sixth embodiment of the present invention.
Figure 8A:
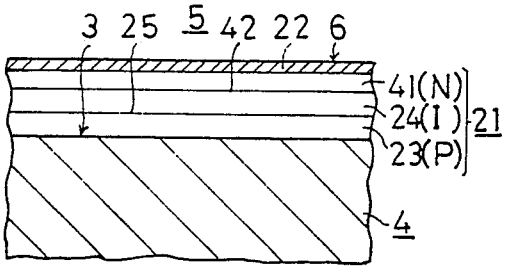
FIGS. 8A and 8B show a mechanical structure and an energy band structure of a seventh embodiment of the present invention.
Figure 8B:
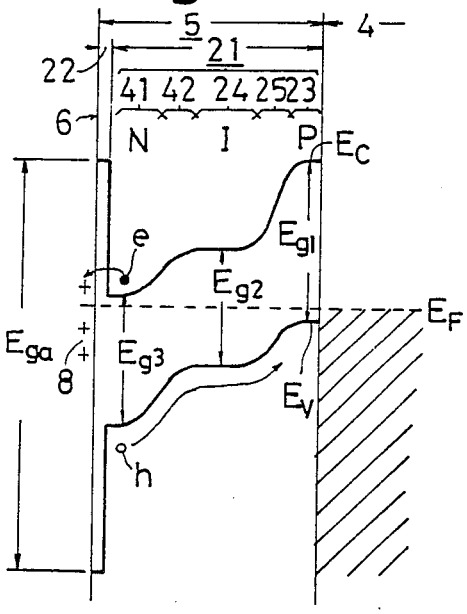
Figure 9A:
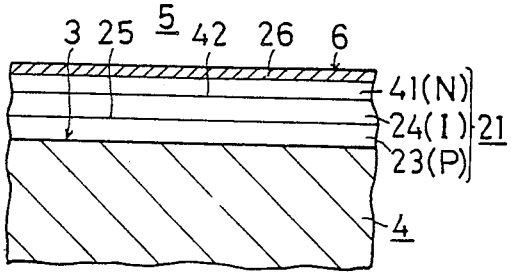
FIGS. 9A and 9B show a mechanical structure and an energy band structure of an eighth embodiment of the present invention.
Figure 9B:
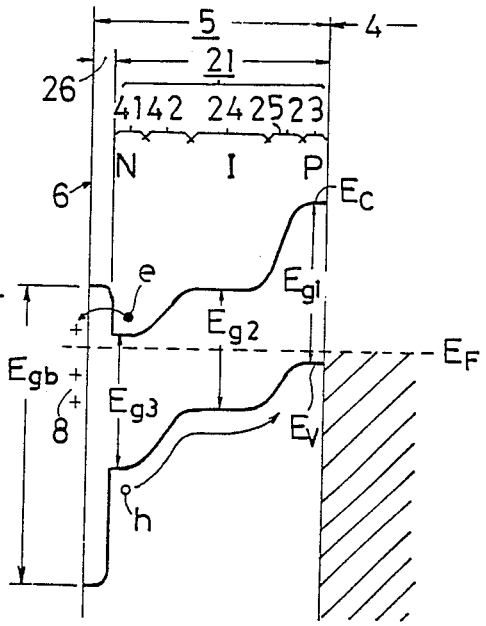

FIG. 7C illustrates a sixth embodiment, in which the parts corresponding to those in FIG. 7B are identified by the same reference numerals. No detailed description will be given. This embodiment is identical in construction with the embodiment of FIG. 7B except that the energy band gaps $Eg_1$, $Eg_2$ and $Eg_3$ of the first, second and third layers 23, 24 and 41 bear such relationships as $Eg_1 > Eg_2$, $Eg_3 > Eg_2$. Hence, this embodiment possesses the same advantages as described above in connection with FIGS. 7B. But since the energy band gaps $Eg_1$, $Eg_2$ and $Eg_3$ of the first, second and third layers 23, 24 and 25 have the abovesaid relationships and since the overall energy band gap has a wide-to-narrow-to-wide structure, the electrical carriers (holes) resulting from incidence of light are directed towards the substrate 4 more quickly than in the embodiment of FIG. 7B. Consequently, it is possible to obtain a print of visible image which is more excellent than that obtainable in the case of FIG. 7B.

FIGS. 8A and 8B and FIGS. 9A and 9B shows seventh and eighth embodiments of the printing member of the present invention, respectively. The parts corresponding to those in FIGS. 7A and 7B are marked with the same reference numerals and no detailed description will be repeated. The embodiment of FIG. 8 is identical in construction with the embodiment of FIG. 7 except that the insulating layer 22 similar to that referred to previously with respect to FIG. 2 is formed on the non-single crystal semiconductor layer 21 The embodiment of FIG. 9 is also identical in construction with the embodiment of FIG. 7 except that the semi-insulating layer 26 similar to those mentioned previously in respect of FIG. 4 is formed on the non-single crystal semiconductor layer 21.

These embodiments of FIGS. 8 and 9 have the insulating layer 22 and the semi-insulating layer 26, respectively, and hence possess the advantages described previously with respect to the insulating layer 22 and the semi-insulating layer 26 in FIGS. 2 and 3, respectively, in addition to the advantages mentioned in connection with FIG. 7.

The foregoing embodiments should be construe as being merely illustrative of the invention and should not be construed in limiting sense. For example, in the arrangement depicted in FIGS. 8A and 8B it is possible to interpose the charge storing non-single crystal semiconductor layer 28 and the charge storing insulating layer 27 between the layer 21 and the insulating layer 22, as is the case with FIG. 5. Also it is possible, in the arrangement of FIG. 9, to interpose the charge storing non-single crystal semiconductor layer 28 and the charge storing semi-insulating layer 29 between the layer 21 and the semi-insulating layer 26, as is the case with FIG. 6.

It will be apparent that many modifications and variations may be effected without departing from the scope of the novel concepts of this invention.

What is claimed is:

1. A printing drum for electrostatic photocopying machine comprising:

a conductive substrate;

a non-single-crystal p-type semiconductor layer formed on said conductive substrate;

a non-single-crystal intrinsic semiconductor layer formed on said p-type semiconductor layer in order to induce a built-in electric field across the interface therebetween; and an insulating layer formed on said intrinsic layer with an external surface to permit the passage of charge photo-generated in said intrinsic layer so that charge on the external surface can be neutralized;

where the band gaps of the p-type layer and the intrinsic layer are equal or the band gap of the p-type layer is less than the band gap of the i-type layer which in turn is substantially less than the band gap of the insulating layer;

where said p-type layer, said intrinsic layer, and said insulating layer are selected from the group consisting of silicon, silicon with nitrogen, silicon with carbon and silicon with oxygen either in stoichiometric or non-stoichiometric amounts.

2. A drum of claim 1 wherein said insulating layer is made of non-single-crystal silicon carbide.

3. A drum of claim 1 wherein said non-single-crystal semiconductor contains material selected from the group consisting of hydrogen, chlorine and fluorine.

4. A printing drum as in claim 1 where $Eg < Eg_2 << Eg_a$ where Eg, $Eg_2$, and $Eg_a$ are the energy bands gaps of the p-type semiconductor layer, the intrinsic semiconductor layer, and the insulating layer, respectively.

5. A printing drum as in claim 4 where said insulating layer is selected from the the group consisting of $SiC_{1-x}(0<x<1)$ and $Si_3N_{4-x}(0<x<4)$.

* * * * *